US008805589B2

(12) United States Patent
Tanaka et al.

(10) Patent No.: US 8,805,589 B2
(45) Date of Patent: Aug. 12, 2014

(54) AIR CONDITIONING OPERATING DEVICE AND AIR CONDITIONING OPERATING METHOD

(75) Inventors: Masato Tanaka, Tokyo (JP); Ryouta Dazai, Tokyo (JP)

(73) Assignee: Azbil Corporation, Tokyo (JP)

( * ) Notice: Subject to any disclaimer, the term of this patent is extended or adjusted under 35 U.S.C. 154(b) by 980 days.

(21) Appl. No.: 12/899,058

(22) Filed: Oct. 6, 2010

(65) Prior Publication Data

US 2011/0082602 A1 Apr. 7, 2011

(30) Foreign Application Priority Data

Oct. 6, 2009 (JP) ..... 2009-232204

(51) Int. Cl.
*G05D 23/00* (2006.01)

(52) U.S. Cl.
USPC ..... 700/276; 700/278; 700/279; 236/1 R; 236/51

(58) Field of Classification Search
None
See application file for complete search history.

(56) References Cited

U.S. PATENT DOCUMENTS

| | | | | |
|---|---|---|---|---|
| 2009/0078782 | A1* | 3/2009 | Phillippo | 236/46 A |
| 2009/0159716 | A1* | 6/2009 | Kim | 236/51 |
| 2010/0280667 | A1* | 11/2010 | Steinberg | 700/276 |

FOREIGN PATENT DOCUMENTS

| | | | |
|---|---|---|---|
| JP | 6-332506 | A | 12/1994 |
| JP | 2003-148790 | A | 5/2003 |
| JP | 2004-225929 | A | 8/2004 |
| JP | 2004-239500 | A | 8/2004 |
| JP | 2008-101897 | A | 5/2008 |
| KR | 1999-0079086 | A | 11/1999 |
| KR | 2004-0066732 | A | 7/2004 |

* cited by examiner

*Primary Examiner* — Mohammad Ali
*Assistant Examiner* — Sheela S Rao
(74) *Attorney, Agent, or Firm* — Troutman Sanders LLP

(57) ABSTRACT

An outdoor air temperature information acquisition section acquires the outdoor air temperature, a room temperature information acquisition section that acquires room temperature, an air conditioner state information acquisition section that acquires information on the state of heat exchange type air conditioners and the outdoor air cooler, an estimated value calculating section for room temperature during outdoor air cooling calculating the estimated value for room temperature after switching to the complete outdoor air cooling mode that stops the heat exchange type air conditioner and carries out room temperature control by only increasing or decreasing the effect of the outdoor air cooler from the cooling mode mainly using the heat exchange type air conditioner. An estimated value display section for room temperature during outdoor air cooling, a switching instruction input section receiving the switching operation to complete outdoor air cooling from the occupant and a switching section carrying out switching to the complete outdoor air cooling mode according to the switching instruction.

14 Claims, 7 Drawing Sheets

AIR CONDITIONING OPERATING DEVICE AND AIR CONDITIONING OPERATING METHOD

CROSS REFERENCE TO RELATED APPLICATIONS

The present application claims priority under 35 U.S.C. §119 to Japanese Patent Application No. 2009-232204, filed Oct. 6, 2009, which is incorporated herein by reference.

TECHNICAL FIELD

The present invention relates to an air conditioning operating device used for an operating part common to heat exchange type air conditioners and outdoor air coolers in air conditioning systems using both a heat exchange type air conditioner and an outdoor air cooler.

BACKGROUND OF THE INVENTION

With air conditioning control, as is shown in FIG. 12, individual air conditioners (for example, multiple air conditioners used for a building) are installed in each room. There are practical implementations of air conditioning systems that operate individual air conditioners according to judgments by occupants with the occupant using a remote control or other operating means (for example, see Published Unexamined Patent Application No. 2003-148790 ("JP '790")). In the example in FIG. 12, rooms 100-1, 100-2 are each provided with a heat exchange type individual air conditioner 101-1, 101-2. In FIG. 12, 102-1, 102-2 are lines returning air (return air) from the rooms 100-1, 100-2 to individual air conditioners 101-1, 101-2; 103-1, 103-2 are lines supplying air (supply air) cooled or heated by the individual air conditioners 101-1, 101-2 to the rooms 100-1, 100-2, and 104-1 and 104-2 are supply air outlets. With this air conditioning system, the occupants operate the individual air conditioners; therefore, many improvements and additional functions have been implemented for the means of operation and display methods for operations as disclosed in JP '790.

Progress is being made with the human-machine interfaces (HMI) for individual air conditioners, and implementations of individual air conditioning using air conditioning interfaces for central air conditioning have been proposed (see Published Unexamined Patent Application No. 2008-101897).

Central air conditioning systems are constituted such that cooling (outside air cooling) is carried out using outside air in winter. In office buildings and the like, the occupants and computer equipment generate substantial heat indoors; therefore, air conditioning is necessary in the daytime even in winter. The energy for cooling air by air conditioners and the like may be saved by outdoor air cooling that cools by bringing in cold outside air. Therefore, outdoor air cooling is extremely effective from the standpoint of conserving energy.

Therefore, a constitution such that individual air conditioners and outside air coolers are used together as in FIG. 13 and the merits of each are used may be considered. In FIG. 13, 105 is an outdoor air cooler and introduces outdoor air into the rooms, 106 an outdoor air inlet, 107-1, 107-2 ducts for supplying outside air sent by an outdoor air cooler 105, 108-1, 108-2 outdoor air dampers for adjusting the amount of the outdoor air supplied, 109-1, 109-2 outdoor air outlets, 110-1, 110-2 room temperature sensors that measure the room temperature and 111 in outdoor air temperature sensor that measures the outdoor air temperature.

However, the HMI for the individual air conditioners is not an HMI for joint use with the outdoor air cooler. Therefore, even if the occupants make constructive efforts toward conserving energy using outdoor air cooling, they cannot determine the possibilities for the trade-offs in the state of cooling; therefore, there is outdoor air for the occupants.

The same can be said of the joint use of air handling units (AHU) and outdoor air coolers in central air conditioning systems. Since AHUs and individual air conditioners are involved with air heat exchange operations, they are distinguished from outdoor air coolers and are described as "heat exchange type air conditioners" herein.

The present invention solves the problems described above, and it is an object thereof to provide an air conditioning operating device and an air conditioning operating method such that an occupant may judge more easily than conventionally whether to switch to outdoor air cooling in an air conditioning system using both a heat exchange type air conditioner and an outdoor air cooler.

SUMMARY OF THE INVENTION

The present invention is an air conditioning operating device in an air conditioning system using both a heat exchange type air conditioner and an outdoor air cooler, having an outdoor air temperature information acquisition means that acquires outdoor air temperature measurement values, a room temperature information acquisition means that acquires room temperature measurement values, an air conditioner state information acquisition means that acquires information about the state of a heat exchange type air conditioner and outdoor air cooler, a means for calculating an estimated value for room temperature during outdoor air cooling that calculates an estimated room temperature value after complete switching to outdoor air cooling mode that stops the heat exchange type air conditioner from a cooling mode mainly using the heat exchange type air conditioner that carries out room temperature control mainly by increasing or decreasing the effect of the heat exchange type air conditioner and carries out room temperature control only by increasing or decreasing the effect of outdoor air cooling based on a measured value for outdoor air temperature, measured value for room temperature, information about the state of the heat exchange type air conditioner and information about the state of the outdoor air cooler, a means for displaying the estimated value for room temperature during outdoor air cooling that shows it such that an occupant may recognize the estimated value for room temperature and a switching means that switches to the complete outdoor air cooling mode according to the results of a determination of whether switching is possible or not based on conditions the occupant has set or switching indicating input by the occupant.

In addition, in one example of the constitution of the air conditioning operating device of the present invention, a condition set by the occupant is the time for switching to the complete outdoor air cooling mode, and the switching means includes a switching time setting means that receives the switching time setting from the occupant and an automatic switching means that carries out the switching to the complete outdoor air cooling mode when the switching time has been reached.

In addition, in one example of the constitution of the air conditioning operating device of the present invention, a condition set by the occupant is a switching delay, which is a delay time for switching to the complete outdoor air cooling mode, and the switching means comprises a switching delay setting means that receives the switching delay setting from the occupant and an automatic switching means that sets a time with the switching delay added to the time set by the switching delay setting as the time for switching to the complete outdoor air cooling mode and carries out switching to the complete outdoor cooling mode when this switching time has been reached.

In addition, in one example of the constitution of the air conditioning operating device of the present invention conditions set by the occupant are the allowable temperature for the room and the end time for a period of time when the occupant desires the room temperature to be at or lower than the allowable temperature, and the switching means has an end time setting means that receives a setting for the end time from the occupant, and allowable temperature setting means that receives a setting for the allowable temperature from the occupant and an automatic switching means that sets the switching time to the complete outdoor air cooling mode and carries out switching to the complete outdoor cooling mode when this switching time is reached with the condition that a temperature equal to or lower than the allowable temperature can be maintained until the end time based on calculation results of the means for calculating an estimated value for room temperature during outdoor air cooling. In addition, in one example of the constitution of the air conditioning operating device of the present invention, the means for calculating an estimated value for room temperature during outdoor air cooling calculates the estimated value for room temperature assuming that outdoor air is taken in with the maximum outdoor air damper opening in complete outdoor air cooling mode.

In addition, in one example of the constitution of the air conditioning operating device of the present invention, the means for calculating an estimated value for room temperature during outdoor air cooling calculates the estimated value for room temperature by a simulation based on a mathematical formula that successively calculates changes in room temperature for a unit time.

In addition, in one example of the constitution of the air conditioning operating device of the present invention, the means for calculating an estimated value for room temperature during outdoor air cooling calculates a time constant for changes in room temperature in the complete outdoor air cooling mode and a convergence temperature inside the room assuming that outdoor air is taken in with the maximum outdoor air damper opening, and based on this time constant and convergence temperature, calculates the estimated value for room temperature at any time.

In addition, the air conditioning operating method of the present invention comprises an outdoor air temperature information acquisition step that acquires outdoor air temperature measurement values, and room temperature information acquisition step that acquires room temperature measurement values, an air conditioner state information acquisition step that acquires information about the state of a heat exchange type air conditioner and outdoor air cooler, a step for calculating an estimated value for room temperature during outdoor air cooling that calculates an estimated room temperature value after complete switching to outdoor air cooling mode that stops the heat exchange type air conditioner from a cooling mode mainly using the heat exchange type air conditioner that carries out room temperature control mainly by increasing or decreasing the effect of the heat exchange type air conditioner and carries out room temperature control only by increasing or decreasing the effect of outdoor air cooling based on a measured value for outdoor air temperature, measured value for room temperature, information about the state of the heat exchange type air conditioner and information about the state of the outdoor air cooler, a step for displaying the estimated value for room temperature during outdoor air cooling that shows it such that an occupant may recognize the estimated value for room temperature and a switching step that switches to the complete outdoor air cooling mode according to the results of a determination of whether switching is possible or not based on conditions the occupant has set or switching indicating input by the occupant.

According to the present invention, the estimated value for room temperature after switching to the complete outdoor air cooling mode from the cooling mode mainly using the heat exchange type air conditioner, and an indicator for making a determination about switching to complete outdoor air cooling is displayed by displaying the estimated value for room temperature that has been calculated to the occupant. Since the determination of whether to switch to complete outdoor cooling is easier for the occupant than it was conventionally, energy conservation activities may be furthered through voluntary determinations by occupants. According to the present invention, an air conditioning operating device introduced such that it becomes easy for occupants to constructively stop the heat exchange type air conditioner may be achieved.

In addition, according to the present invention, there may be automatic switching to the complete outdoor cooling mode when a setting for a switching time to the complete outdoor air cooling mode has been received from an occupant and the switching time has been reached. The trouble of the occupant's confirming the estimated value for room temperature many times may be reduced.

In addition, according to the present invention, the trouble of the occupant's confirming the estimated value for the estimated value for room temperature many times may be reduced by receiving a setting for a day to switch to the complete outdoor air cooling mode from the occupant, setting a time with the switching day added to the time implemented by the switching day setting as the time for switching to the complete outdoor air cooling mode and carrying out switching to the complete outdoor air cooling mode when this switching time is reached.

In addition, according to the present invention, the trouble of the occupant's confirming the estimated value for room temperature many times may be reduced by receiving a setting for the end time, receiving a setting for the allowable temperature from the occupant and setting the time for switching to the complete outdoor air cooling mode with the condition that a temperature equal to or lower than the allowable temperature may be maintained until the end time based on the calculation results of the means for calculating an estimated value for room temperature during outdoor air cooling and carrying out switching to the complete outdoor air cooling mode when this switching time has been reached.

In addition, according to the present invention, the estimated value for room temperature that is calculated forms the estimated value for room temperature when controlling the maximum limit for increases in temperature by calculating the estimated value for room temperature assuming that outdoor air is taken in with the maximum outdoor air damper opening in the complete outdoor air cooling mode. Therefore, the most effective indicator for making a determination is shown to the occupant.

DETAILED DESCRIPTION OF THE INVENTION

Figure 1:
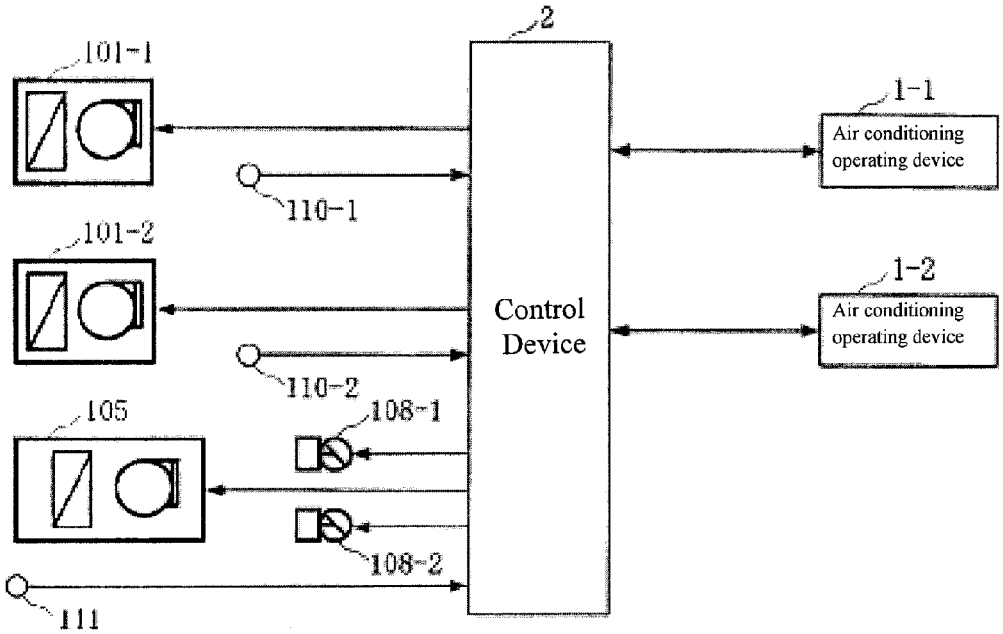
FIG. 1 is a block diagram showing the constitution of an air conditioning system according to an example of the present invention.

When a heat exchange type air conditioner is stopped, and the state is set completely to outdoor air cooling only (complete outdoor air cooling), there is a possibility that the heat exchange type air conditioner must be restarted immediately because of an insufficiency in the cooling capacity of outdoor air cooling only, depending on the articles generating heat in the room and the outdoor air temperature conditions. In other words, the energy conservation activity of using complete outdoor air cooling itself increases the possibility of starting and stopping on the heat exchange type air conditioner side. Therefore, the inventors have taken into consideration the fact that it is preferable to display the estimated value for room temperature when complete outdoor air cooling is implemented according to a judgment by an occupant to reduce the possibility of the heat exchange type air conditioner having to restart against the intentions of the occupant to reduce the energy consumed by switching to complete outdoor air cooling.

Specifically, displaying the value estimated for the room temperature when the heat exchange type air conditioner is stopped and a state of completely cooling with outdoor air is established (complete outdoor air cooling) in a state with the maximum outdoor air being taken in (outdoor air damper at maximum opening) such that the occupant may understand it was considered. By this means, the occupant may understand that in practice there is surplus cooling capacity when the energy conservation activity of stopping the heat exchange type air conditioner is undertaken.

An occupant in a room, using the room, for example, for the purpose of a meeting, may make a different judgment about switching to complete outdoor air cooling according to how long the meeting will continue after switching to complete outdoor cooling. Therefore, it would be preferable to be able to estimate how the temperature will change with the passage of time and display it for the display of the estimated value for room temperature rather than estimating only the final range of room temperature increase and displaying it.

Considering uses for the display of the estimated value for room temperature, it is unnecessary to have room temperature changes in a continuous time sequence, and highly precise estimated values for room temperature are unnecessary. It is sufficient just to obtain an approximate value for the room temperature estimate at a main target time such as 30 minutes, 60 minutes or 90 minutes after the time of switching to complete outdoor air cooling. If the occupants are roughly fixed, the standards for determining whether to use complete outdoor air cooling based on the estimated value for room temperature are probably learned individually. Therefore, displaying a prediction of the changes in temperature with the passage of time using a prescribed calculation method is particularly significant.

For example, let the display of the estimated values for room temperature be approximately 28° C. for the estimated value for room temperature 30 minutes after switching to complete outdoor air cooling, approximately 31° C. for the estimated value for room temperature 60 minutes afterwards and 33° C. in for the estimated value for room temperature 90 minutes afterwards. When a meeting is expected to continue for 60 minutes from the current time, let the occupants allow the room temperature to go to 28° C. after 30 minutes, but not allow the room temperature to go to 31° C. 60 minutes after it. Since a judgment must be made on whether to switch to complete outdoor air cooling and a confirmed time for the estimated value room temperature in this case, the occupants do not select the operation of going to complete outdoor air cooling even if there is an interest in reducing energy consumption.

Therefore, if the switching time may be set to 30 minutes before the estimated time for completion of the meeting, the occupants may reduce the trouble of confirming the estimated value of the room temperature many times. In other words, if the time for which the estimated value for room temperature when switching to complete outdoor air cooling is, for example, 14:00, the estimated time for completing the meeting 15:00 and the estimated values for room temperature approximately 28° C. after 30 minutes and approximately 31° C. after 60 minutes and if 14:30 is set for the switching time at 14:00, there is automatic stopping of the heat exchange type air conditioner and switching to complete outdoor air cooling in the indicated switching time. By this means, the occupants are done with one confirmation of the estimated value for room temperature at 14:00. It goes without saying that the switching time may be any time, 14:35, for example, rather than 14:30.

In addition, the allowable temperature and the time the meeting ends may be set from the beginning to obtain the same effect. In other words, the allowable temperature is set at 28° C., and the meeting ending time is set at 15:00. If the estimated value for the room temperature is approximately 28° C. after 30 minutes and approximately 31° C. after 60 minutes, the heat exchange type air conditioner will stop and switch automatically to complete outdoor air cooling around 14:30. By this means the occupants are, for the time being, done with one confirmation of the estimated value for room temperature at the time it is set.

Figure 13:
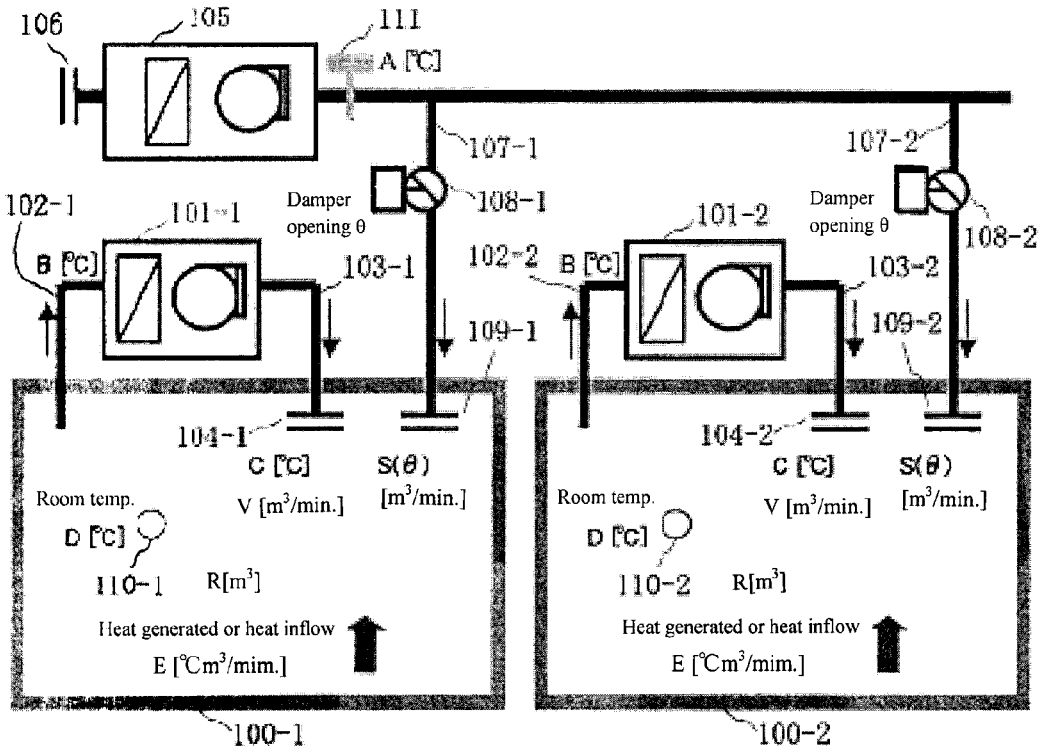
FIG. 13 is a drawing showing the constitution of an air conditioning system using both a heat exchange type air conditioner and an outside air cooler.

In the following, examples of the present invention will be described in detail with reference to the drawings. FIG. 1 is a block diagram showing the constitution of an air conditioning system according to a first embodiment of the present invention. The present example corresponds to the principles described above. The arrangement for the various constitutions of the air conditioning system is as shown in FIG. 13. Therefore, the air conditioning system of the present embodiment will be described using the element numbers in FIG. 13.

Air-conditioning operating devices 1-1, 1-2 are installed inside rooms 100-1, 100-2. Instructions are given to a control device 2 through operations by the occupants or automatic processing, and information is acquired from control device 2.

The control device 2, for example, carries out control such that the room temperature of the room 100-1 is the room temperature setting set by the air conditioning operating device 1-1 by controlling the amount of cold water supplied to the heat exchanger of the heat exchange type air conditioner 101-1, the opening of an outside air damper 108-1 and the like. Likewise, the control device 2 carries out control such that the room temperature of the room 100-2 is the room temperature setting set by the air conditioning operating device 1-2 by controlling the amount of cold water supplied to the heat exchanger of the heat exchange type air conditioner 101-2, the opening of an outside air damper 108-2 and the like.

The two cooling modes for the air conditioning system, which are a cooling mode mainly using the heat exchange type air conditioner that implements room temperature control mainly by increasing or decreasing the effect of the heat exchange type air conditioner and a complete outdoor air cooling mode that implements room temperature control by only increasing or decreasing the effect of the outdoor air cooler, are present in each room. In the cooling mode mainly using the heat exchange type air conditioner, the outdoor air cooler also operates, but in the complete outdoor cooling mode, only the outdoor air cooler operates, and the heat exchange type air conditioner is stopped.

The control device 2 takes into consideration the room temperature setting set by the air conditioning operating devices 1-1, 1-2, the outdoor air temperature, the room temperature of rooms 100-1, 100-2 and the like. The control mode, either the cooling mode mainly using the heat exchange type air conditioner or the complete outdoor air cooling mode is selected for each room, and each room is air-conditioned individually. Moreover, the mode the control device 2 selects may be implemented appropriately without affecting the substance of the present invention. Therefore, detailed descriptions of automatic selection for the control mode are omitted. In addition, the control device 2 receives switching instructions from occupants of rooms 100-1, 100-2 through air conditioning operating devices 1-1, 1-2, and when there is a switching instruction from an occupant, switching to the control mode selected by the occupant is carried out.

Figure 2:
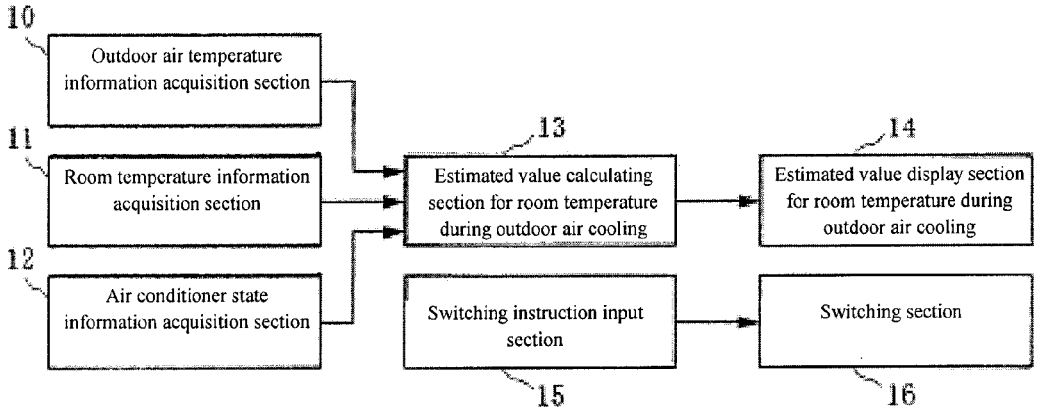
FIG. 2 is a block diagram showing the constitution an air conditioning operating device according to the present invention.

FIG. 2 is a block diagram showing the constitution of air conditioning operating devices 1-1, 1-2. Each of the air conditioning operating devices 1-1, 1-2 comprises an outdoor air temperature information acquisition section 10 that acquires the respective measured values for outdoor air temperature, a room temperature information acquisition section 11 that acquires a measured value for room temperature, an air conditioner state information acquisition section 12 that acquires information on the state of heat exchange type air conditioners 101-1, 101-2 and outdoor air cooler 105, an estimated value calculating section 13 for room temperature during outdoor air cooling that calculates the estimated value for room temperature after switching to the complete outdoor air cooling mode from the cooling mode mainly using the heat exchange type air conditioner, an estimated value display section 14 for room temperature during outdoor air cooling, a switching instruction input section 15 that receives the switching operation to complete outdoor air cooling from the occupant and a switching section 16 that carries out switching to the complete outdoor air cooling mode according to the switching instruction input from the occupant.

Next, the operation of the air conditioning operating devices 1-1, 1-2 of the present example will be described. Here, the operation of the air conditioning operating device 1-1 will be described, but except for the change in the room targeted, air conditioning operating device 1-2 operates in the same manner.

The switching instruction input section 15 of the air conditioning operating device 1-1 receives an operation for switching to complete outdoor air cooling from an occupant in room 100-1. When switching instruction input section 15 has received an operation instructing switching to the complete outdoor air cooling mode, the switching section 16 of the air conditioning operating device 1-1 outputs a switching instruction signal to the control device 2. The control device 2 switches the room 100-1 control mode from the cooling mode mainly using the heat exchange type air conditioner to the complete outdoor air cooling mode according to this switching instruction signal.

In the following, the operation for displaying the estimated value for room temperature during complete outdoor air cooling to the occupant as an indicator for determining whether to switch to complete outdoor air cooling will be described. As was described previously, the estimated value for room temperature during complete outdoor air cooling does not require showing temperature changes for a continuous time sequence and does not require highly precise room temperature estimations. Therefore, various methods and levels for the method for calculating the estimated value for room temperature may be considered. For example, a method based on a mathematical formula for a physical model of heat balance may be used. Alternatively, a method where data showing the input-output relation for the control target is analyzed by a class II fuzzy quantification technique as disclosed in Published Unexamined Patent Application No. H6-332506 and a mathematical formula derived by calculating an approximate model function for the characteristic distribution obtained as a result may be used.

The method described below is only one example. The substance of the present invention is to display estimated value for room temperature during complete outdoor air cooling to the occupants using a heat exchange type air conditioner even when it is, for example, an approximate value.

The method for estimating the room temperature during complete outdoor air cooling varies according to the conditions of the targeted room, air conditioning equipment and the like. Therefore, a comparatively simple example is shown to make it easy to understand.

Here, let A [° C.] be the measured outdoor air temperature at the present time, $\theta$ the outdoor air damper opening at the present time, $\theta p$ the maximum outdoor air damper opening during outdoor air cooling, $S(\theta)$ [$m^3$/min.] the amount of air conveyed by an outside air cooler fan, $S(\theta p)$ [$m^3$/min.] the maximum amount of air conveyed by the outside air cooler fan, B [° C.] the temperature of the return air returning to the heat exchange type air conditioner from the room at the present time, C [° C.] the temperature of the supply air supplied from the heat exchange type air conditioner at the present time, V [$m^3$/min.] the amount of air conveyed by the heat exchange type air conditioner fan, D [° C.] the measured room temperature at the present time, E [° $Cm^3$/min.] the estimated value for the heat energy generated in the room, F [° C.] the estimated room temperature and R [$m^3$] the volume of the room.

The measured outdoor air temperature A is measured by an outdoor air temperature sensor 111. The outdoor air temperature information acquisition section 10 of the air conditioning operating device 1-1 acquires the measured outdoor air temperature A via the control device 2. The measured room temperature D in room 100-1 is measured by a room temperature sensor 110-1. The room temperature information acquisition section 11 of the air conditioning operating device 1-1 acquires the measured room temperature D in room 100-1 via the control device 2.

The air conditioner state information acquisition section 12 of the air conditioning operating device 1-1 acquires the information for the opening θ for the outdoor air damper 108-1 for room 100-1 at the present time, the temperature C of the supply air supplied by the heat exchange type air conditioner 101-1 for room 100-1, the amount of air conveyed V by the heat exchange type air conditioner 101-1 fan and the known volume of the room R for room 100-1 from the control device 2.

In addition, the relation for the outdoor air damper opening and amount of air conveyed by the outdoor air cooler 105 fan is registered in the air conditioner state information acquisition section 12 in advance. Based on this relation, the air conditioner state information acquisition section 12 can find the amount of air conveyed S(θ) by the outdoor air cooler 105 fan at the present time from the outdoor air damper opening θ at the present time. It goes without saying that when the outdoor air damper opening is the maximum value θp, the amount of air conveyed is the maximum value S(θp). Moreover, the amount of air conveyed V by the heat exchange type air conditioner 101-1 fan is a fixed value in the present embodiment.

Assuming that B≈D, and assuming that there is a state of thermal equilibrium at the present time, the following relation may be expected.

$$E=(D-C)V+(D-A)S(\theta) \tag{1}$$

If the change in room temperature after changing to complete outdoor air cooling is expressed in a mathematical formula as proportional to a temperature difference in the same manner as thermal conductivity for air mixing efficiency, there is the following relation. Here, ΔF/Δt signifies the amount of change in temperature per unit time.

$$R\Delta F/\Delta t=-(F-A)S(\theta p)+E \tag{2}$$

$$R(F'-F)/\Delta t=-(F-A)S(\theta p)+E \tag{3}$$

$$F'=F+\{-(F-A)S(\theta p)+E\}\Delta t/R \tag{4}$$

$$F'=F+\{-(F-A)S(\theta p)+(D-C)V+(D-A)S(\theta)\}\Delta t/R \tag{5}$$

In sequential computations using Equation (2) through Equation (5), the estimated value for room temperature F' may be calculated using a simple simulation if the initial temperature for F is D. Forecasts of changes in conditions such as outdoor air temperature may be included using Equation (2) through Equation (5).

Since in actual fact the following formula conversion is possible, the time constant T for temperature changes by complete outside air cooling and the convergence temperature G within the room may be estimated.

$$F'=F+\{-(F-A)S(\theta p)+E\}\Delta t/R \tag{6}$$

$$F'=F\{1-S(\theta p)\Delta t/R\}+\{A+E/S(\theta p)\}\{S(\theta p)\Delta t/R\} \tag{7}$$

$$F'=F\{1-\Delta t/T\}+G\Delta t/T \tag{8}$$

$$T=R/S(\theta p) \tag{9}$$

$$G=A+E/S(\theta p)=A+\{(D-C)V+(D-A)S(\theta)\}/S(\theta p) \tag{10}$$

Therefore, the estimated value for room temperature F'(t) at any time t may be obtained by the following equation using time constant T and convergence temperature G. With Equation (11), predicted changes in conditions such as the outdoor air temperature may not be included, but the amount of computation may be reduced.

$$F'(t)=D+(G-D)\{1-\exp(-t/T)\} \tag{11}$$

The estimated value calculating section 13 for room temperature during outdoor air cooling for the air conditioning operating device 1-1 calculates the estimated value E for the heat energy generated in the room 100-1 at the present time from the measured outdoor air temperature A acquired by the outdoor air temperature information acquisition section 10, the measured room temperature D acquired by the room temperature information acquisition section 11, the supply air temperature C acquired by the air conditioner state information acquisition section 12, the amount of air conveyed S(θ) by the outdoor air cooler 105 fan and the amount of air conveyed V by the heat exchange type air conditioner 101-1 fan using Equation (1).

Next, the estimated value calculating section 13 for room temperature during outdoor air cooling calculates the time constant T from the volume of the room R for room 100-1 acquired by the air conditioner state information acquisition section 12 and the known maximum amount of air conveyed by the outside air cooler fan S(θp) using Equation (9). In addition, the estimated value calculating section 13 for room temperature during outdoor air cooling calculates the convergence temperature G from the measured outdoor air temperature A, the known maximum amount of air conveyed S (θp) and the estimated value E for the heat energy generated in the room 100-1 using Equation (10). Finally, the estimated value calculating section 13 for room temperature during outdoor air cooling calculates the estimated value for room temperature F'(t) at any time t from the measured room temperature D, time constant T and convergence temperature G using Equation (11).

The estimated value display section 14 for room temperature during outdoor air cooling of the air conditioning operating device 1-1 displays the estimated value for room temperature F'(t) such that the occupants of room 100-1 may recognize it. Moreover, it may not be practically possible to calculate the values for time constant T and the like, and they may be adjusted to constant values set in advance to conform to the actual changes.

Next, an example of a simulation using specific numerical values will be given in the following. To verify the estimating equations in Equation (1) through Equation (11), confirmation was done by starting the intake of outside air with the maximum outdoor air damper opening from a state with absolutely no articles generating heat in the room with no cooling by a heat exchange type air conditioner nor intake of outside air. This case is simulation 1.

In simulation 1, A [° C.]=18.0 [° C.] is the measured outdoor temperature at the present time, 8=0.0 the outdoor air damper opening at the present time, θp=1.0 the maximum outdoor air damper opening during outdoor air cooling, S(θ) [$m^3$/min.]=0.0 [$m^3$/min.], the amount of air conveyed by an outside air cooler fan, S (θp) [$m^3$/min.]=1.0 [$m^3$/min.] the maximum amount of air conveyed by the outside air cooler fan, B [° C.]=25.0 [° C.] the current temperature of the return air for the heat exchange type air conditioner, C [° C.]=25.0 [° C.] the current temperature of the supply for the heat exchange type air conditioner, V [$m^3$/min.]=2.0 [$m^3$/min.] the amount of air conveyed by the heat exchange type air conditioner fan, D [° C.]=25.0 [° C.] the measured room temperature at the present time and R [$m^3$]=100.0 [$m^3$] the volume of the room (5.0 m×8.0 m×2.5 m height) and unit time Δt=1.0 [min.].

The estimated value E for the heat energy generated in the room, time constant T, convergence temperature G and estimated value for room temperature F'(t) are calculated as follows using Equation (1), Equation (9), Equation (10) and Equation (11).

$$E=(D-C)V+(D-A)S(\theta)=0.0\ [°\ \mathrm{C.\ m^3/min.}] \tag{12}$$

$$T=R/S(\theta p)=100.0\ [\mathrm{min.}] \tag{13}$$

$$G=A+E/S(\theta p)=18.0\ [°\ \mathrm{C.}] \tag{14}$$

$$F'(t)=D+(G-D)\{1-\exp(-t/T)\}=25.0-7.0\{1-\exp(-t/100.0)\} \tag{15}$$

Figure 3:
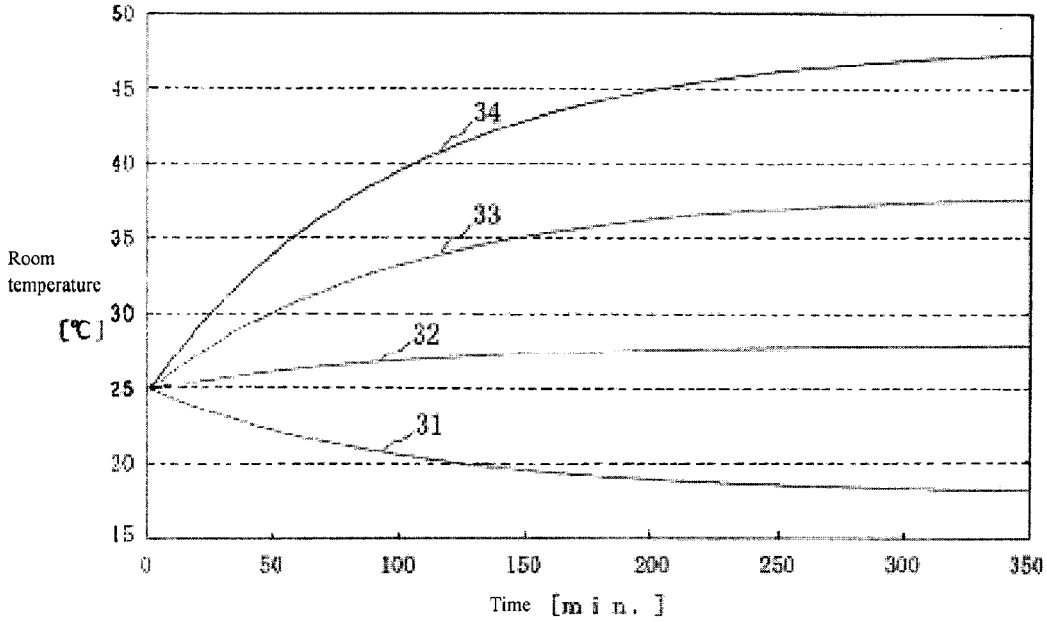
FIG. 3 is a drawing showing the results of room temperature change simulations based on the method for calculating room temperature estimates of the present invention.
Figure 4:
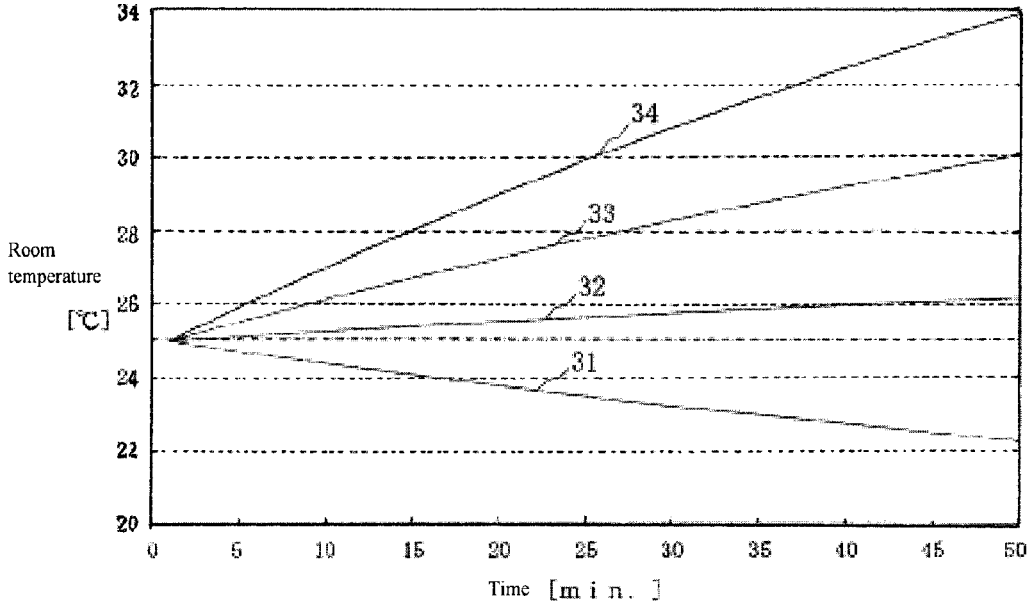
FIG. 4 is a drawing showing the results of room temperature change simulations based on the method for calculating room temperature estimates of the present invention.

When there is switching to complete outdoor air cooling under the simulation 1 conditions using Equation (12) through Equation (15), for example, it can be estimated that the room temperature drops to approximately 23.2° C. after 30 minutes, drops to approximately 21.9° C. after 60 minutes and drops to approximately 20.9° C. after 90 minutes. Furthermore, after approximately 6 hours, the room temperature will be substantially the same as the outside air, dropping to approximately 18.2° C. The results of a simulation calculating the estimated value for room temperature under the simulation 1 conditions are shown in FIG. 3 and FIG. 4. FIG. 4 is an enlarged drawing showing the 0 to 50 [min.] range in FIG. 3. In FIG. 3 and FIG. 4, 31 is the change in room temperature based on the results of simulation 1, 32, 33 and 34 are the changes in room temperature based on the results of simulations 2, 3 and 4, respectively, that will be described hereinafter. When it is assumed that the temperature will not rise with outdoor air cooling only as in simulation 1 above, an estimated value for room temperature of 25.0° C. may be displayed to the occupants.

Next, to verify the estimating equations in Equation (1) through Equation (11), confirmation was done for the case of switching to complete outdoor air cooling with the outdoor air damper at the maximum opening from a state where the air conditioning was controlled at 25.0° C. by a heat exchange type air conditioner and outside air for the purpose of ventilation in a state where there were some articles generating heat in the room. This case is simulation 2.

In simulation 2, A [° C.]=18.0 [° C.] is the measured outdoor temperature at the present time, θ=0.5 the outdoor air damper opening at the present time, θp=1.0 the maximum outdoor air damper opening during outdoor air cooling, S(θ) [$m^3$/min.]=0.5 [$m^3$/min], the amount of air conveyed by an outside air cooler fan, S (θp) [$m^3$/min.]=1.0 [$m^3$/min.] the maximum amount of air conveyed by the outside air cooler fan, B [° C.]=25.0 [° C.] the current temperature of the return air for the heat exchange type air conditioner, C [° C.]=21.75 [° C.] the current temperature of the supply for the heat exchange type air conditioner, V [$m^3$/min.]=2.0 [$m^3$/min.] the amount of air conveyed by the heat exchange type air conditioner fan, D [° C.] 25.0 [° C.] the measured room temperature at the present time and R [$m^3$]=100.0 [$m^3$] the volume of the room (5.0 m×8.0 m×2.5 m height) and unit time Δt=1.0 [min.].

The estimated value E for the heat energy generated in the room, time constant T, convergence temperature G and estimated value for room temperature F'(t) are calculated as follows using Equation (1), Equation (9), Equation (10) and Equation (11).

$$E=(D-C)V+(D-A)S(\theta)=10.0\ [°\ \mathrm{C.\ m^3/min.}] \tag{16}$$

$$T=R/S(\theta p)=100.0\ [\mathrm{min.}] \tag{17}$$

$$G=A+E/S(\theta p)=28.0\ [°\ \mathrm{C.}] \tag{18}$$

$$F'(t)=D+(G-D)\{1-\exp(-t/T)\}=25.0+3.0\{1-\exp(-t/100.0)\} \tag{19}$$

When there is switching to complete outdoor air cooling under the simulation 2 conditions using Equation (16) through Equation (19), for example, it can be estimated that the room temperature rises to approximately 25.8° C. after 30 minutes, rises to approximately 26.3° C. after 60 minutes and rises to approximately 26.8° C. after 90 minutes. The results of a simulation calculating the estimated value for room temperature under the simulation 2 conditions are shown by 32 in FIG. 3 and FIG. 4.

When, for example, occupants viewing the estimated value for room temperature displayed by the estimated value display section 14 for room temperature during outdoor air cooling use room 100-1 for the purpose of a meeting, they determine that an increase of approximately 1.8° C. 90 minutes later will not be a problem because the meeting will end in 90 minutes and they will leave the room. At this time, occupants that want to practice energy conservation will switch to complete outdoor air cooling mode by their own volition by operating the air conditioning operating device 1-1.

Next, to verify the estimating equations in Equation (1) through Equation (11), confirmation was done for the case of switching to complete outdoor air cooling from a state where the air conditioning was controlled at 25.0° C. by a heat exchange type air conditioner and outdoor air cooling with the outdoor air damper at a maximum opening in a state where there were many articles generating heat in the room. This case is simulation 3. In simulation 3, A [° C.]=18.0 [° C.] is the measured outdoor temperature at the present time, θ=1.0 the outdoor air damper opening at the present time, θp=1.0 the maximum outdoor air damper opening during outdoor air cooling, S(θ) [$m^3$/min.]=1.0 [$m^3$/min.], the amount of air conveyed by an outside air cooler fan, S(θp) [$m^3$/min.]=1.0 [$m^3$/min.] the maximum amount of air conveyed by the outside air cooler fan, B [° C.]=25.0 [° C.] the current temperature of the return air for the heat exchange type air conditioner, C [° C.]=18.5 [° C.] the current temperature of the supply for the heat exchange type air conditioner, V [$m^3$/min.]=2.0 [$m^3$/min.] the amount of air conveyed by the heat exchange type air conditioner fan, D [° C.]=25.0 [° C.] the measured room temperature at the present time and R [$m^3$]=100.0 [$m^3$] the volume of the room (5.0 m×8.0 m×2.5 m height) and unit time Δt=1.0 [min.].

The estimated value E for the heat energy generated in the room, time constant T, convergence temperature G and estimated value for room temperature F'(t) are calculated as follows using Equation (1), Equation (9), Equation (10) and Equation (11).

$$E=(D-C)V+(D-A)S(\theta)=20.0\ [^\circ\ \text{C. m3/min.}] \quad (20)$$

$$T=R/S(\theta p)=100.0\ [\text{min.}] \quad (21)$$

$$G=A+E/S(\theta p)=38.0\ [^\circ\ \text{C.}] \quad (22)$$

$$F'(t)=D+(G-D)\{1-\exp(-t/T)\}=25.0+13.0\{1-\exp(-t/100.0)\} \quad (23)$$

When there is switching to complete outdoor air cooling under the simulation 3 conditions using Equation (20) through Equation (23), for example, it can be estimated that the room temperature rises to approximately 28.3° C. after 30 minutes, rises to approximately 30.8° C. after 60 minutes and rises to approximately 32.7° C. after 90 minutes. The results of a simulation calculating the estimated value for room temperature under the simulation 3 conditions are shown by 33 in FIG. 3 and FIG. 4.

When, for example, occupants viewing the estimated value for room temperature displayed by the estimated value display section 14 for room temperature during outdoor air cooling use room 100-1 for the purpose of a meeting, they determine that an increase of approximately 3.3° C. 30 minutes later will not be a problem because the meeting will end in 30 minutes and they will leave the room. At this time, occupants that want to practice energy conservation will switch to complete outdoor air cooling mode by their own volition by operating the air conditioning operating device 1-1. On the other hand, when the occupants determine that the meeting will continue at least 60 minutes and they cannot permit the room temperature to rise approximately 5.8° C. after 60 minutes, they will not switch to complete outdoor air cooling to avoid restarting the heat exchange type air conditioner even if they have a desire to practice energy conservation.

Next, to verify the estimating equations in Equation (1) through Equation (11), confirmation was done for the case of switching to complete outdoor air cooling from a state where the air conditioning was controlled at 25.0° C. by two heat exchange type air conditioners and outdoor air cooling with the outdoor air damper at a maximum opening in a state where there were very many articles generating heat in the room. This case is simulation 4.

In simulation 4, A [° C.]=18.0 [° C.] is the measured outdoor temperature at the present time, θ=1.0 the outdoor air damper opening at the present time, θp=1.0 the maximum outdoor air damper opening during outdoor air cooling, S(θ) [$m^3$/min.]=1.0 [$m^3$/min.], the amount of air conveyed by an outside air cooler fan, S(θp) [$m^3$/min.]=1.0 [$m^3$/min.] the maximum amount of air conveyed by the outside air cooler fan, B [° C.]=25.0 [° C.] the current temperature of the return air for the heat exchange type air conditioner, C [° C.]=19.25 [° C.] the current temperature of the supply for the heat exchange type air conditioner, 2.0 [$m^3$/min.] the air conveyed per heat exchange type air conditioner, [V [$m^3$/min.]=4.0 [$m^3$/min.] the amount of air conveyed by the fans of the two heat exchange type air conditioners, D [° C.]=25.0 [° C.] the measured room temperature at the present time and R [$m^3$]=100.0 [$m^3$] the volume of the room (5.0 m×8.0 m×2.5 m height) and unit time Δt=1.0 [min.].

The estimated value E for the heat energy generated in the room, time constant T, convergence temperature G and estimated value for room temperature F'(t) are calculated as follows using Equation (1), Equation (9), Equation (10) and Equation (11).

$$E=(D-C)V+(D-A)S(\theta)=30.0\ [^\circ\ \text{C. m3/min.}] \quad (24)$$

$$T=R/S(\theta p)=100.0\ [\text{min.}] \quad (25)$$

$$G=A+E/S(\theta p)=48.0\ [^\circ\ \text{C.}] \quad (26)$$

$$F'(t)=D+(G-D)\{1-\exp(-t/T)\}=25.0+23.0\{1-\exp(-t/100.0)\} \quad (27)$$

Under the simulation 4 conditions using Equation (24) through Equation (27), for example, it can be estimated that the room temperature rises to approximately 30.8° C. after 30 minutes, rises to approximately 35.3° C. after 60 minutes and rises to approximately 38.6° C. after 90 minutes. The results of a simulation calculating the estimated value for room temperature under the simulation 4 conditions are shown by 34 in FIG. 3 and FIG. 4.

When, for example, occupants viewing the estimated value for room temperature displayed by the estimated value display section 14 for room temperature during outdoor air cooling use room 100-1 for the purpose of a meeting, they determine that an increase of approximately 5.8° C. 30 minutes later cannot be permitted. Even if the occupants desire to practice energy conservation at this time, they will not switch to complete outdoor air cooling to avoid restarting the heat exchange type air conditioners.

Thus, in the present embodiment, the estimated value for room temperature during complete outdoor air cooling is calculated, and an indicator for making a determination about switching to complete outdoor air cooling is displayed by displaying the estimated value for room temperature that has been calculated to the occupant. Since the determination of whether to switch to complete outdoor cooling is easier for the occupant than it was conventionally, energy conservation activities may be furthered through voluntary determinations by occupants. In addition, in the present embodiment, the estimated value for room temperature that is calculated forms the estimated value for room temperature when controlling the maximum limit for increases in temperature by calculating the estimated value for room temperature assuming that outdoor air is taken in with the maximum outdoor air damper opening during complete outdoor air cooling. Therefore, the most effective indicator for making a determination may be shown to the occupant.

Moreover, the estimated value for room temperature may constantly be calculated, constantly displayed. It may be calculated and displayed according to the needs of the occupants.

Figure 5:
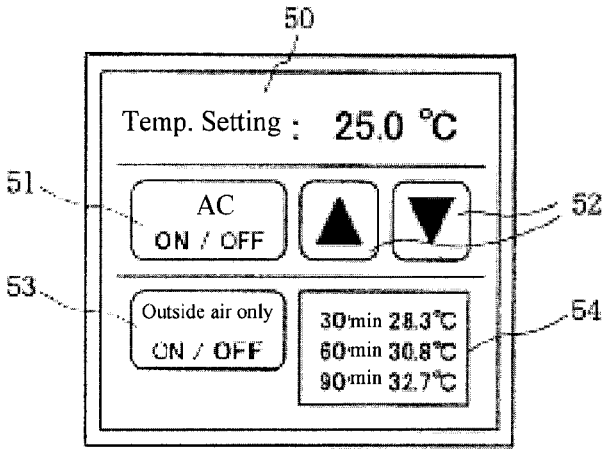
FIG. 5 is a drawing showing an example of an air conditioning operating device display and operating panel of the present invention.

FIG. 5 shows an example of a display and operation panel for air conditioning operating devices 1-1, 1-2 of the present embodiment. In FIG. 5, 50 is a display area that displays a room temperature setting, 51 an air conditioning ON/OFF switch and air conditioning ON/OFF display area, 52 a room temperature setting change switch, 53 complete outdoor air cooling ON/OFF switch and complete outdoor air cooling ON/OFF display area and 54 a display area that displays the estimated value for room temperature.

The estimated value display section 14 for room temperature during outdoor air cooling for the air conditioning operating devices 1-1, 1-2 displays the estimated value for room temperature in the display area 54. When occupants switch to complete outdoor air cooling, they operate the complete outdoor air cooling ON/OFF switch 53. When the switching section 16 for the air conditioning operating devices 1-1, 1-2 switches to complete outdoor air cooling mode, the complete outdoor air cooling ON/OFF display area 53 displays the fact that switching to complete outdoor air cooling mode has been done.

Next, another example of the present invention will be described. The present example corresponds to the principles of the present invention described above. In the present example the constitution of the air conditioning system is the same as that described above; therefore, the explanation will use the element numbers in FIG. 1.

Figure 6:
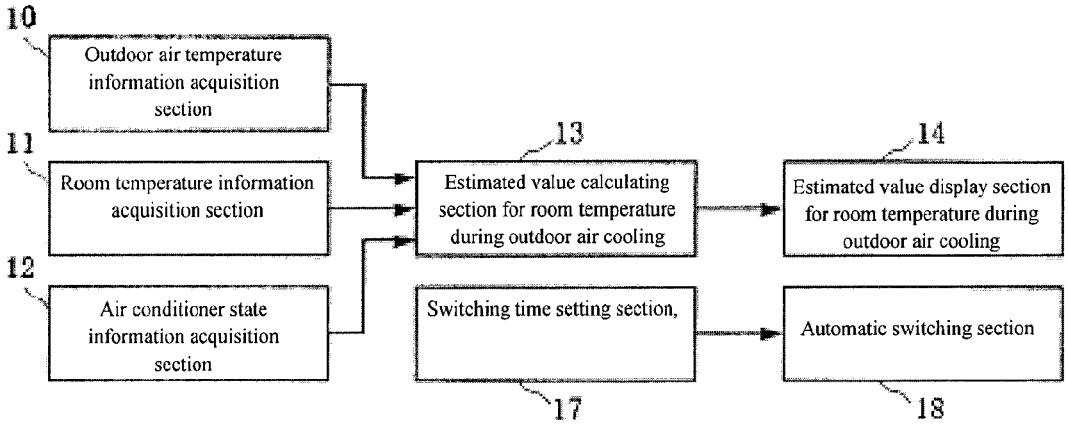
FIG. 6 is a block diagram showing the constitution of an air conditioning operating device according to another example of the present invention.

FIG. 6 is a block diagram showing the constitution of air conditioning operating devices 1-1, 1-2. Each air conditioning operating device 1-1, 1-2 comprises its own outdoor air temperature information acquisition section 10, room temperature information acquisition section 11, air conditioner state information acquisition section 12, estimated value calculating section 13 for room temperature during outdoor air cooling, estimated value display section 14 for room temperature during outdoor air cooling, switching time setting section 17 that receives a switching time setting from an occupant and automatic switching section 18 that switches to the complete outdoor air cooling mode when a switching time is reached.

Figure 7:
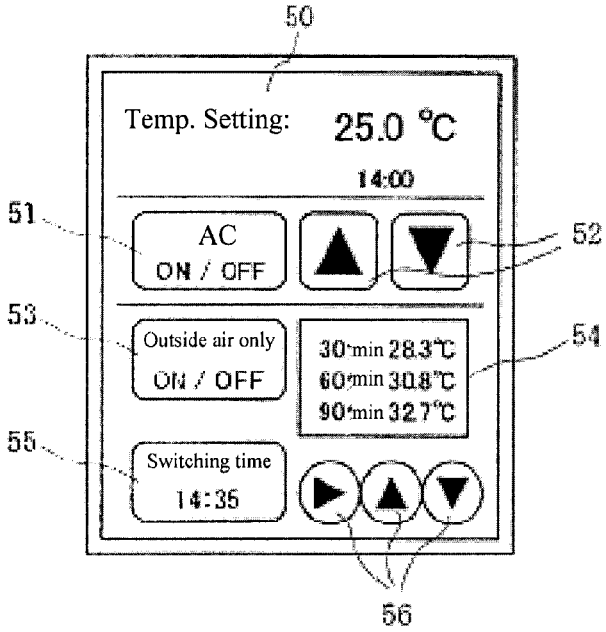
FIG. 7 is a drawing showing an example of an air conditioning operating device display and operating panel of the other example of the present invention.

FIG. 7 shows an example of a display and operation panel for air conditioning operating devices 1-1, 1-2 of the present embodiment. The same element numbers as in FIG. 5 are applied to the display areas and switches) that are the same as FIG. 5. In FIG. 7, 55 is a display area that shows the time for switching to complete outdoor air cooling and 56 is the setting switch for the switching time.

Next, the operation of the air conditioning operating devices 1-1, 1-2 of the present example will be described. As in the explanation of the above example, the estimated value display section 14 for room temperature during outdoor air cooling for the air conditioning operating device 1-1 displays the estimated value for room temperature in the display area 54. Here, the occupant has confirmed the estimated value for room temperature displayed in the display area 54 at 14:00. The planned time for ending the meeting in room 100-1 is 15:00. If the states of the room 100-1 and air conditioning system are as given in simulation 3 described above, the estimated value for room temperature will rise from 25.0° C. to approximately 28.3° C. after 30 minutes, rise to approximately 30.8° C. after 60 minutes and rise to approximately 32.7° C. after 90 minutes.

The occupants determine that a gradual rise to do the extent of approximately 28° C. in 30 minutes is the allowable range. Therefore, the occupants judge that there would be no problem if they switched to complete outdoor air cooling at 14:30, which is before 15:30. Leaving a little margin, time for switching to complete outdoor air cooling is set at 14:35, and the switching time is set by operating setting switch 56.

The switching time setting section 17 of the air conditioning operating device 1-1 displays the switching time that is set in the display area 55 and notifies the automatic switching section 18. When the 14:35 switching time is reached, the automatic switching section 18 outputs a switching instruction signal to the control device 2 and displays the fact that switching to the complete outdoor air cooling mode has been done in the complete outdoor air cooling ON/OFF display area 53. The control device 2 switches the room 100-1 control mode from the cooling mode mainly using the heat exchange type air conditioner to the complete outdoor air cooling mode according to the switching instruction signal.

Thus, in the present example, the occupants may automatically switch to control mode to complete outdoor air cooling mode at a switching time judged to be suitable. Therefore, the occupants can reduce the trouble of confirming the estimated value of the room temperature many times.

Next, a further example of the present invention will be described. The present example corresponds to the principles of the present invention described above. In the present example the constitution of the air conditioning system is the same as that in the above example; therefore, the explanation will use the element numbers in FIG. 1.

Figure 8:
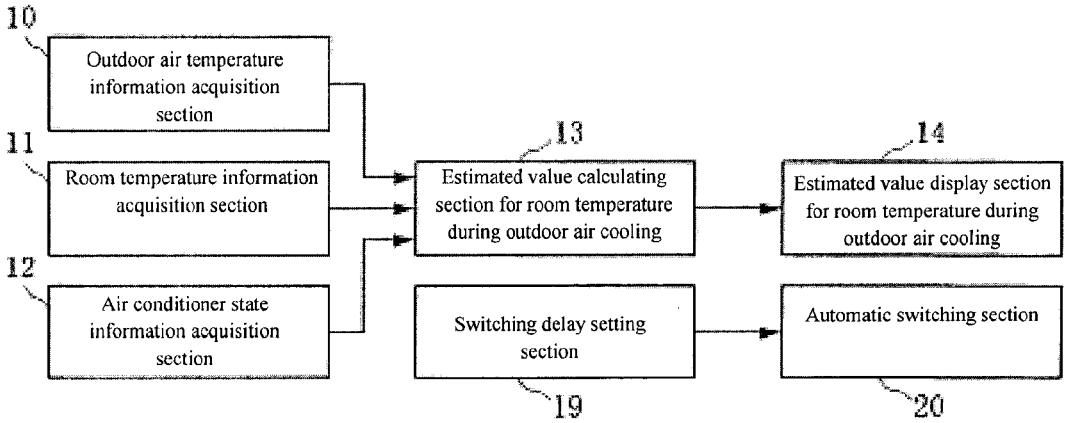
FIG. 8 is a block diagram showing the constitution an air conditioning operating device according to a further example of the present invention.

FIG. 8 is a block diagram showing the constitution of air conditioning operating devices 1-1, 1-2. Each air conditioning operating device 1-1, 1-2 comprises its own outdoor air temperature information acquisition section 10, room temperature information acquisition section 11, air conditioner state information acquisition section 12, estimated value calculating section 13 for room temperature during outdoor air cooling, estimated value display section 14 for room temperature during outdoor air cooling, switching delay setting section 19 that receives a switching delay setting from an occupant and automatic switching section 20 that sets the time for switching to the complete outdoor cooling mode to a time with the switching delay added to the time set by the switching delay setting and switches to the complete outdoor air cooling mode when this switching time is reached.

Figure 9:
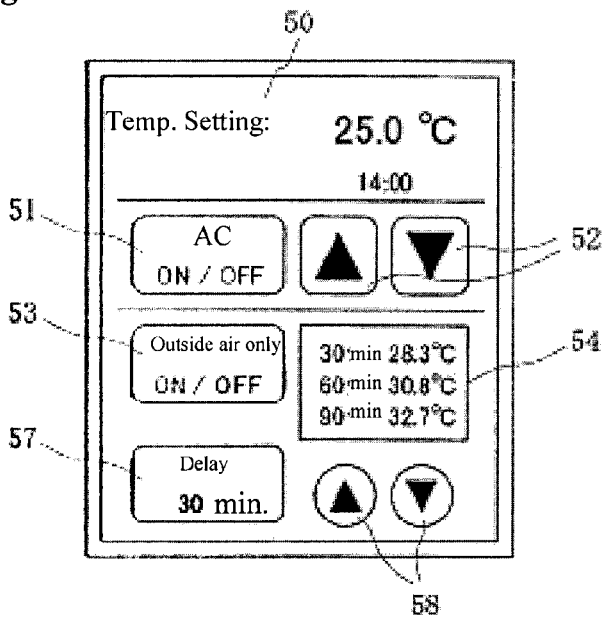
FIG. 9 is a drawing showing an example of an air conditioning operating device display and operating panel of the present invention.

FIG. 9 shows an example of a display and operation panel for air conditioning operating devices 1-1, 1-2 of the present example. The same element numbers as in FIG. 5 are applied to the display areas and switches that are the same as FIG. 5. In FIG. 9, 57 is a display area that displays the switching delay, which is the delayed time for switching to complete outdoor air cooling.

Next, the operation of the air conditioning operating devices 1-1, 1-2 of the present example will be described. As in the explanation of the above example, the estimated value display section 14 for room temperature during outdoor air cooling for the air conditioning operating device 1-1 displays the estimated value for room temperature in the display area 54. Here, the occupant has confirmed the estimated value for room temperature displayed in the display area 54 at 14:00. The planned time for ending the meeting in room 100-1 is 15:00. If the states of the room 100-1 and air conditioning system are as given in simulation 3 described above, the estimated value for room temperature will rise from 25.0° C. to approximately 28.3° C. after 30 minutes, rise to approximately 30.8° C. after 60 minutes and rise to approximately 32.7° C. after 90 minutes.

The occupants determine that a gradual rise to do the extent of approximately 28° C. in 30 minutes is the allowable range. Therefore, the occupants judge that there would be no problem if they switched to complete outdoor air cooling at 14:30, which is before 15:30. The 30 minutes to the switching time 14:30 from the current time of 14:00 is set as the switching delay, and the switching delay is set by operating a setting switch 58.

The switching delay setting section 19 of the air conditioning operating device 1-1 displays the switching delay that has been set in the display area 57, sets a time with the switching delay added to the time set by the switching delay setting for the switching time and notifies the automatic switching section 20 of this switching time. When the 14:30 switching time is reached, the automatic switching section 20 outputs a switching instruction signal to the control device 2 and displays the fact that switching to the complete outdoor air cooling mode has been done in the complete outdoor air cooling ON/OFF display area 53. The control device 2 switches the room 100-1 control mode from the cooling mode mainly using the heat exchange type air conditioner to the complete outdoor air cooling mode according to the switching instruction signal. Thus, the present example may provide the same effect as the above example.

Next, an example of the present invention will be described. The present example corresponds to the principles of the present invention described above. In the present example, the constitution of the air conditioning system is the same as that in the above example; therefore, the explanation will use the element numbers in FIG. 1.

Figure 10:
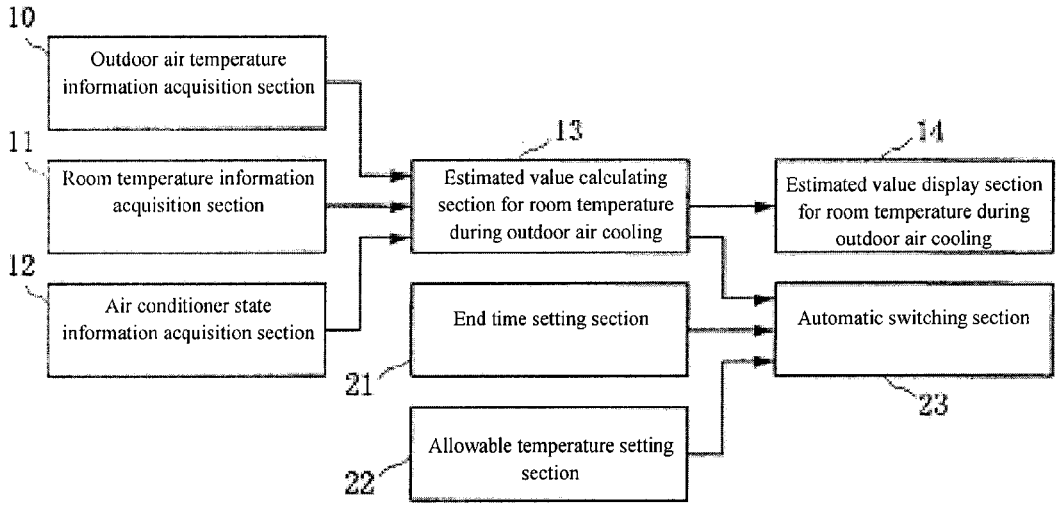
FIG. 10 is a block diagram showing the constitution of an air conditioning operating device according to an example of the present invention.

FIG. 10 is a block diagram showing the constitution of air conditioning operating devices 1-1, 1-2. Each air conditioning operating device 1-1, 1-2 includes its own outdoor air temperature information acquisition section 10, room temperature information acquisition section 11, air conditioner state information acquisition section 12, estimated value calculating section 13 for room temperature during outdoor air cooling, estimated value display section 14 for room temperature during outdoor air cooling, end time setting section 21 that receives an end time setting from an occupant, allowable temperature setting section 22 that receives an allowable temperature setting from an occupant and an automatic switching section 23 that sets the time for switching to the complete outdoor cooling mode with the condition of maintaining a temperature or equal to or less than the allowable temperature up to the end time based on the results of calculations by the estimated value display section 14 for room temperature during outdoor air cooling and switches to the complete outdoor air cooling mode when this switching time is reached.

Figure 11:
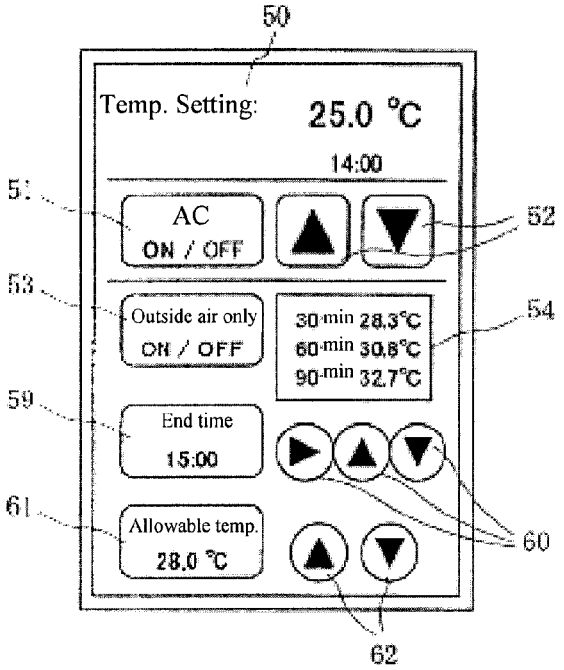
FIG. 11 is a drawing showing an example of an air conditioning operating device display and operating panel of the present invention.
Figure 12:
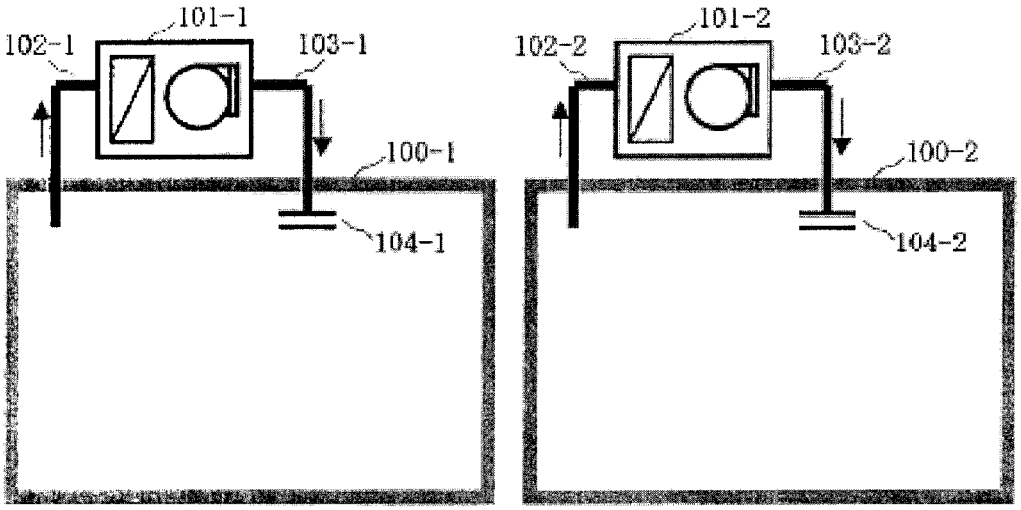
FIG. 12 is a drawing showing the constitution of a conventional air conditioning system using only a heat exchange type air conditioner.

FIG. 11 shows an example of a display and operation panel for air conditioning operating devices 1-1, 1-2 of the present embodiment. The same element numbers as in FIG. 5 are applied to the display areas and switches that are the same as FIG. 5. In FIG. 11, 59 is a display area that displays the end time for the time period during which the occupants desire to have the room temperature at or below the allowable temperature, 60 a setting switch for the end time, 61 a display area that displays the allowable temperature for the room temperature and 62 a setting switch for the allowable temperature.

Next, the operation of the air conditioning operating devices 1-1, 1-2 of the present example will be described. As in the explanation of the above example, the estimated value display section 14 for room temperature during outdoor air cooling for the air conditioning operating device 1-1 displays the estimated value for room temperature in the display area 54. Here, the occupant has confirmed the estimated value for room temperature displayed in the display area 54 at 14:00. The planned time for ending the meeting in room 100-1 is 15:00. If the states of the room 100-1 and air conditioning system are as given in simulation 3 described above, the estimated value for room temperature will rise from 25.0° C. to approximately 28.3° C. after 30 minutes, rise to approximately 30.8° C. after 60 minutes and rise to approximately 32.7° C. after 90 minutes.

Since the planned end time for the meeting is 15:00, the occupants set the end time to 15:00, and the end time is set by operating the setting switch 60. The end time setting section 21 of the air conditioning operating device 1-1 displays the end time that is set in the display area 59 and notifies the automatic switching section 23. In addition, the occupants set the allowable temperature for the room to 28° C. and set the allowable temperature by operating settings switch 62. The allowable temperature setting section 22 of the air conditioning operating device 1-1 displays the allowable temperature that is set in the display area 61 and notifies the automatic switching section 23.

The automatic switching section 23 of the air conditioning operating device 1-1 discerns that the estimated value for room temperature will rise to approximately 28.3° C. after 30 minutes, rise to approximately 30.8° C. after 60 minutes and rise to approximately 32.7° C. after 90 minutes from the results of calculations by the estimated value calculating section 13 for room temperature during outdoor air cooling. Therefore, if the automatic switching section 23 switches to complete outdoor air cooling at 14:30, which is before the 15:30 set as the end time, the judgment is that the 28° C. set as the allowable temperature may be substantially maintained up to the end time, and 14:30 is set as the time for switching to complete outdoor air cooling. When 14:30 is reached, the automatic switching section 23 outputs a switching instruction signal to the control device 2 and displays the fact that switching to the complete outdoor air cooling mode has been done in the complete outdoor air cooling ON/OFF display area 53. The control device 2 switches the room 100-1 control mode from the cooling mode mainly using the heat exchange type air conditioner to the complete outdoor air cooling mode according to the switching instruction signal.

Thus, the present example may provide the same effect as the above example. Moreover, the switching time set by the automatic switching section 23 may be a rough setting. In the examples above, the estimated value for room temperature rises to 28.3° C. 30 minutes after switching to complete outdoor air cooling, but the automatic switching section 23 ignores the estimated value for room temperature after the decimal point, and if there is a switch to complete outdoor air cooling at 14:30, the judgment is that the 28° C. that is set as the allowable temperature may be maintained up to the end time.

Moreover, each of the control devices 2 for the air conditioning operating devices 1-1, 1-2 in the above examples may be implemented by a computer provided with a CPU and storage device and a program that controls hardware resources. The CPU for each device executes the processing described in the examples according to a program stored in the storage device.

The present invention may be used in an air conditioning system using both a heat exchange type air conditioner and an outdoor air cooler.

The invention claimed is:

1. An air conditioning operating device in an air conditioning system using both a heat exchange type air conditioner and an outdoor air cooler, the air conditioning operating device comprising:

an outdoor air temperature information acquisition device acquiring outdoor air temperature measurement values;

a room temperature information acquisition device acquiring room temperature measurement values;

an air conditioner state information acquisition device acquiring information about a state of a heat exchange type air conditioner and a state of the outdoor air cooler;

calculator calculating an estimated value for room temperature during outdoor air cooling and calculating the estimated value for room temperature after switching to a complete outdoor air cooling mode that stops the heat exchange type air conditioner, from a cooling mode mainly using the heat exchange type air conditioner that carries out room temperature control mainly by increasing or decreasing an effect of the heat exchange type air conditioner, and carries out the room temperature control only by increasing or decreasing an effect of the outdoor air cooler, based on a measured value for outdoor air temperature, a measured value for room temperature, information about the state of the heat exchange type air conditioner and information about the state of the outdoor air cooler;

a display displaying the estimated value for room temperature during outdoor air cooling such that an occupant may recognize the estimated value for room temperature; and a switch switching to the complete outdoor air cooling mode according to results of a determination of whether switching is possible or not based on one or more conditions the occupant has set or switching indicating input by the occupant.

2. The air conditioning operating device according to claim 1, wherein:

the condition set by the occupant is a switching time for switching to said complete outdoor air cooling mode, and said switch comprises:

a switching time setting section that receives a setting for the switching time from said occupant; and an automatic switch carrying out the switching to said complete outdoor air cooling mode when said switching time has been reached.

3. The air conditioning operating device according to claim 1 wherein:

the condition set by the occupant is a switching delay, which is a delay time for switching to said complete outdoor air cooling mode, and said switch comprises:

a switching delay setting device receiving a setting for the switching delay from said occupant; and an automatic switch setting a time for switching by adding said switching delay to a time at which said setting for the switching delay is performed, as the time for switching to said complete outdoor air cooling mode, and carrying out switching to said complete outdoor cooling mode when this time for switching has been reached.

4. The air conditioning operating device according to claim 1 wherein:

the conditions set by said occupant are an allowable temperature for a room and an end time for a period of time when said occupant desires the room temperature to be at or lower than the allowable temperature, said switch comprises:

an end time setting device receiving a setting for said end time from said occupant;

an allowable temperature setting device receiving a setting for said allowable temperature from said occupant; and an automatic switch setting a switching time to said complete outdoor air cooling mode and carrying out switching to said complete outdoor cooling mode when this switching time is reached with a condition that a temperature equal to or lower than said allowable temperature can be maintained until said end time, based on calculation results of said calculator of the estimated value for room temperature during outdoor air cooling.

5. The air conditioning operating device according to claim 1 wherein:

said calculator calculates said estimated value for room temperature assuming that outdoor air is taken in with a maximum outdoor air damper opening in said complete outdoor air cooling mode.

6. The air conditioning operating device according to claim 1 wherein:

said calculator calculates said estimated value for room temperature by a simulation based on a mathematical formula that successively calculates changes in room temperature for a unit time.

7. The air conditioning operating device according to claim 1 wherein:

said calculator calculates a time constant for changes in room temperature in said complete outdoor air cooling mode and a convergence temperature inside a room assuming that outdoor air is taken in with a maximum outdoor air damper opening, and based on the time constant and the convergence temperature, and calculates said estimated value for room temperature at any given time.

8. An air conditioning operating method using both a heat exchange type air conditioner and an outdoor air cooler, the method comprising the steps of:

an outdoor air temperature information acquisition step acquiring outdoor air temperature measurement values, a room temperature information acquisition step acquiring room temperature measurement values, an air conditioner state information acquisition step acquiring information about a state of a heat exchange type air conditioner and a state of the outdoor air cooler, a calculating step calculating an estimated value for room temperature during outdoor air cooling and calculating the estimated value for room temperature after switching to a complete outdoor air cooling mode that stops the heat exchange type air conditioner, from a cooling mode mainly using the heat exchange type air conditioner that carries out room temperature control mainly by increasing or decreasing an effect of the heat exchange type air conditioner, and carries out the room temperature control only by increasing or decreasing an effect of the outdoor air cooler, based on said measured value for outdoor air temperature, a measured value for room temperature, information about the state of the heat exchange type air conditioner and information about the state of the outdoor air cooler;

a displaying step displaying said estimated value for room temperature during outdoor air cooling such that an occupant may recognize said estimated value for room temperature; and a switching step switching to said complete outdoor air cooling mode according to results of a determination of whether switching is possible or not based on one or more conditions the occupant has set or switching indicating input by the occupant.

9. The air conditioning operating method according to claim 8 wherein:

the condition set by the occupant is a switching time for switching to said complete outdoor air cooling mode, and said switching step comprises the steps of:

a switching time setting step receiving a setting for the switching time from said occupant; and an automatic switching step carrying out the switching to said complete outdoor air cooling mode when said switching time has been reached.

10. The air conditioning operating method according to claim 8 wherein:

the condition set by the occupant is a switching delay, which is a delay time for switching to said complete outdoor air cooling mode, said switching step comprises the steps of:

a switching delay setting step receiving a setting for the switching delay from said occupant; and an automatic switching step setting a time for switching by adding said switching delay to a time at which said setting for the switching delay is performed, as the time for switching to said complete outdoor air cooling mode, and carrying out switching to said complete outdoor cooling mode when this time for switching has been reached.

11. The air conditioning operating method according to claim 8 wherein:

the conditions set by said occupant are an allowable temperature for a room; and an end time for a period of time when said occupant desires the room temperature to be at or lower than the allowable temperature, said switching step comprises the steps of:

an end time setting step receiving a setting for said end time from said occupant; and an allowable temperature setting step receiving a setting for said allowable temperature from said occupant and an automatic switching step setting a switching time to said complete outdoor air cooling mode and carrying out switching to said complete outdoor cooling mode when this switching time is reached with a condition that a temperature equal to or lower than said allowable temperature can be maintained until said end time, based on calculation results of said step for calculating the estimated value for room temperature during outdoor air cooling.

12. The air conditioning operating method according to claim 8 wherein:

said calculating step calculates said estimated value for room temperature assuming that outdoor air is taken in with a maximum outdoor air damper opening in said complete outdoor air cooling mode.

13. The air conditioning operating method according to claim 8 wherein:

said calculating step calculates said estimated value for room temperature by a simulation based on a mathematical formula that successively calculates changes in room temperature for a unit time.

14. The air conditioning operating method according to claim 8 wherein:

said calculating step calculates a time constant for changes in room temperature in said complete outdoor air cooling mode and a convergence temperature inside a room assuming that outdoor air is taken in with a maximum outdoor air damper opening, and based on the time constant and the convergence temperature, and calculates said estimated value for room temperature at any given time.

* * * * *